United States Patent [19]

Beardmore

[11] Patent Number: 4,457,269

[45] Date of Patent: Jul. 3, 1984

[54] VALVE TIMING DRIVE FOR AN INTERNAL COMBUSTION ENGINE

[75] Inventor: John M. Beardmore, Howell, Mich.

[73] Assignee: General Motors Corporation, Detroit, Mich.

[21] Appl. No.: 372,979

[22] Filed: Apr. 29, 1982

[51] Int. Cl.[3] ..... F01L 1/02

[52] U.S. Cl. ..... 123/90.31; 192/41 R; 474/101; 474/148

[58] Field of Search ..... 123/90.31; 474/84, 101, 474/148, 152; 192/41 R

[56] References Cited

U.S. PATENT DOCUMENTS 3,396,988 8/1968 Kroening ..... 474/84

*Primary Examiner*—William R. Cline

*Assistant Examiner*—Peggy A. Neils

*Attorney, Agent, or Firm*—Donald F. Scherer

[57] ABSTRACT

An engine camshaft is driven from the crankshaft through a timing chain such that the chain has a taut side and a slack side. A second chain is drive connected between the crankshaft and a sprocket member which is maintained on the camshaft by a one-way device. The second chain has a taut side and a slack side opposite the corresponding sides of the primary timing chain. During the engine operating cycle, a torque reversal occurs at the camshaft. The second chain prevents the torque reversal from loosening or overrunning the taut side of the primary timing chain. The one-way device permits adjustment of the primary timing chain due to wear while maintaining the taut side of the second chain.

3 Claims, 11 Drawing Figures

VALVE TIMING DRIVE FOR AN INTERNAL COMBUSTION ENGINE

This invention relates to timing drives and more particularly to flexible member drives for engine valve timing.

The valve timing drives of internal combustion engines, wherein a camshaft is utilized, generally include a flexible drive member between the crankshaft and the camshaft. These flexible drive members take the form of rubber type belts, roller chains or inverted toothed chains. The inverted toothed chain is more commonly called a silent chain. The chain tensioner requirement is more important with a four-cylinder engine than with a six or more cylinder engine. This is because the camshaft of a four-cylinder engine undergoes a low speed torque reversal during the operating cycle. That is, the torque imposed on the camshaft sprocket changes from a reaction type to a drive type torque component. When this torque reversal occurs, the normally taut side of the flexible drive member has a tendency to become the slack side. This results in noise, impact loading of the drive member and wear of the drive member. It is the function of the chain tensioning structure to eliminate or lessen these disadvantages.

The present invention is operable to eliminate the slackening of the normal taut side of the drive member during cyclical torque reversals by incorporating a secondary chain while eliminating the normal external type chain tensioner. The secondary chain is drivingly connected between the crankshaft and a sprocket which is mounted on the camshaft through a mechanism which permits the sprocket to overrun the camshaft in the direction of forward rotation. If the camshaft attempts to overrun the sprocket member, the drive mechanism transmits the torque associated with this overrunning attempt to the crankshaft via the secondary chain. The span of the secondary chain which is maintained in a taut relationship is opposite to the taut span of the normal timing chain. Should either of the chains experience wear, this secondary chain mechanism will automatically compensate such that both chains will maintain their desired taut spans.

It is therefore an object of this invention to provide an improved valve timing drive for an internal combustion engine wherein primary and secondary drive chains are connected between the crankshaft and camshaft and wherein the secondary drive chain is drive connected to the camshaft through a one-way device and has a taut span opposite the taut span of the primary drive chain.

It is another object of this invention to provide an improved valve timing drive for an internal combustion engine wherein a primary drive chain which maintains the valve timing has a taut span on one side of the drive and driven sprockets and the secondary drive chain has a taut span on the other side of the sprockets, and wherein the secondary drive chain prevents torque reversals on the camshaft from momentarily loosening the taut side of the primary drive chain.

It is a further object of this invention to provide an improved valve timing drive for an internal combustion engine wherein a primary drive chain which maintains the valve timing has a taut span on one side of the drive and driven sprockets, the secondary drive chain has a taut span on the other side of the sprockets which secondary drive chain prevents torque reversals of the camshaft from momentarily loosening the taut side of the primary drive chain, and a drive transmitting mechanism is disposed between the camshaft and the secondary drive chain to transmit torque during reversal and to permit continuous adjustment of the timing drive for maintenance of the taut side on both chains.

These and other objects and advantages of the present invention will be more apparent from the following description and drawings in which.

Figure 1:
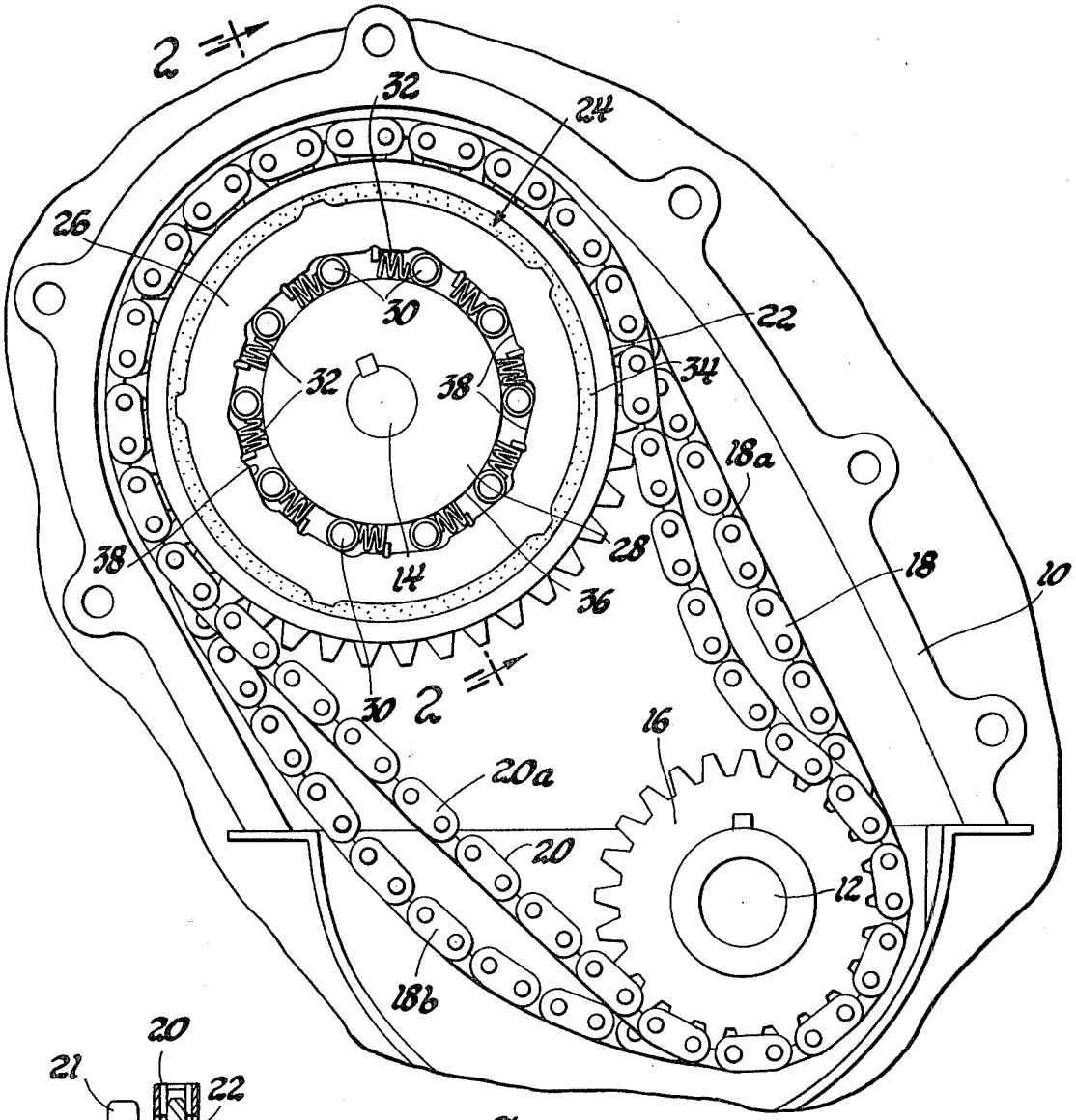
FIG. 1 is an elevational view of an internal combustion engine valve timing drive mechanism with the cover removed.
Figure 2:
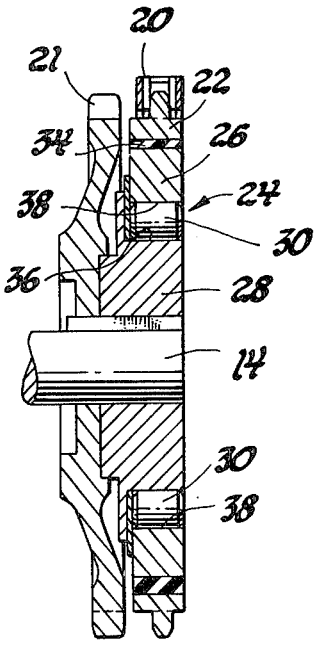
FIG. 2 is a sectional view taken along line 2—2 of FIG. 1.
Figure 3:
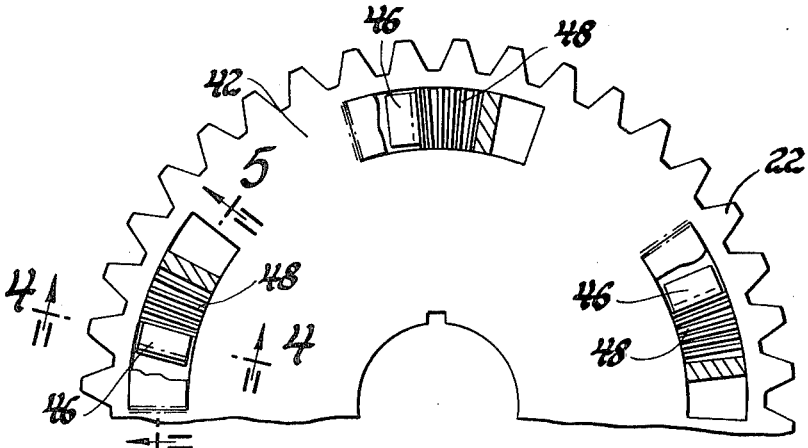
FIG. 3 is another embodiment of a portion of the drive transmitting structure shown in FIG. 1.
Figure 4:
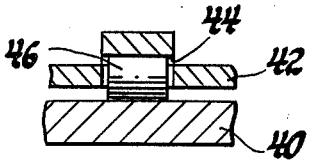
FIG. 4 is a sectional view taken along line 4—4 of FIG. 3.
Figure 5:
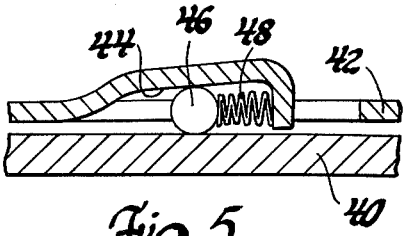
FIG. 5 is a view taken along line 5—5 of FIG. 3.

Referring to the drawings, particularly in FIG. 1, there is seen an internal combustion engine end wall 10 in which is rotatably disposed an engine crankshaft 12 and camshaft 14. The crankshaft 12 has drivingly connected thereto a sprocket 16 which engages a primary timing chain 18 and a secondary chain 20.

The camshaft 14 has drivingly connected thereto a pair of sprockets 21 and 22. Sprocket 21 is drivingly connected to the camshaft 14 while sprocket 22 is drivingly connected to the camshaft 14 through a one-way mechanism 24. The one-way mechanism 24 includes an outer race 26, an inner race 28, a plurality of rollers 30 and a plurality of spring members 32. The sprocket 22 is secured to the outer race 26 through an elastomeric member 34.

The inner race 28 has a substantially cylindrical outer surface 36 and is drivingly connected to the camshaft 14 at its inner surface. The outer race 26 has formed thereon at its inner surface a plurality of cam surfaces 38. The rollers 30 are disposed between the surfaces 36 and 38 and are urged into abutment therewith by the springs 32. When the camshaft 14 is rotated clockwise, as viewed in FIG. 1, a drive component is transmitted from the inner race 28 through rollers 30 and outer race 26 to the sprocket 22. Sprocket 22 is connected to the secondary chain 20 while sprocket 21 is connected to the primary chain 18.

Figure 11:
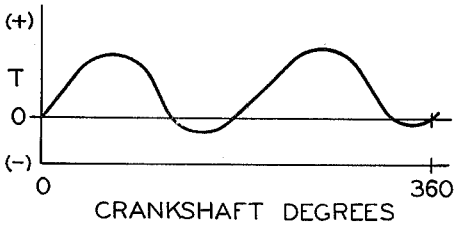
FIG. 11 is a graph depicting the relation of a four cylinder camshaft torque to crankshaft rotation at low engine speeds.

As seen in FIG. 11, as the crankshaft rotates, the torque necessary to drive camshaft 14 through chain 18 varies from a reactive type torque to a driving type torque. The reactive type torque, that is, when the crankshaft is driving the camshaft, is denoted as a (+) torque and the driving type torque which occurs when the camshaft attempts to overrun the crankshaft is denoted as a (−) torque. This torque reversal is partially due to the valve return spring loading which is imposed on the camshaft of the internal combustion engine. When this torque reversal occurs, the normally taut span 18*a* of chain 18 attempts to slacken while the normally slack span 18*b* attempts to tighten. This would result in impact loading on the chain member and sprockets. However, with the present invention, when this torque reversal occurs, the camshaft 14 is operable to drive chain 20 through the one-way mechanism 24 such that the normally taut span 20*a* of chain 20 will prevent the camshaft from overrunning the crankshaft, thus eliminating the slackening of chain 18 at its taut span 18*a*.

During normal wear of the chain 18, the span 18*a* will attempt to slacken at which time the crankshaft 12 progresses ahead of the camshaft, or as viewed differently, the camshaft is retarded relative to the crankshaft. When this relative displacement occurs, the secondary chain 20 and one-way mechanism 24 are operable to maintain the tautness of chains 18 and 20.

The structure shown in FIGS. 3 to 6 utilize one-way drive mechanisms in which the races 40 and 42 are disposed in axial spacing rather than in radial spacing as shown in FIG. 1. The race 40 has formed thereon sprocket 21, and race 42 has formed thereon sprocket 22. The race 42 has formed integrally therewith a plurality of cam surfaces 44. The one-way drive mechanism of FIG. 3 utilizes a plurality of rollers 46 which are positioned by spring members 48 so as to continually abut between the race 40 and cam surfaces 44.

Figure 6:
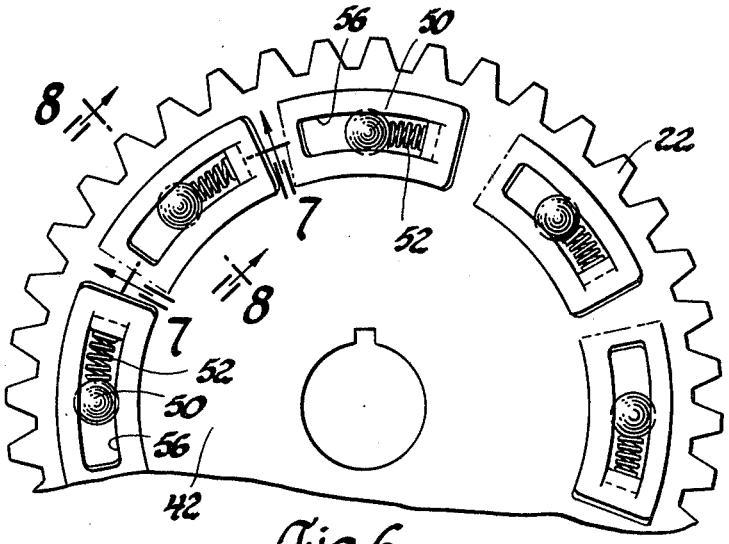
FIG. 6 is another embodiment of a portion of the drive mechanism shown in FIG. 1.
Figure 7:
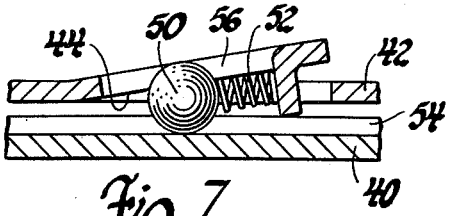
FIG. 7 is a view taken along line 7—7 of FIG. 6.
Figure 8:
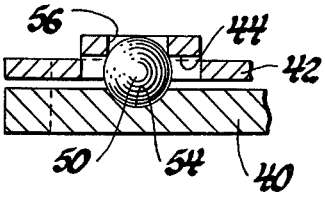
FIG. 8 is a view taken along line 8—8 of FIG. 6.

The one-way device shown in FIG. 6 utilizes spherical members 50 which are positioned by springs 52 between the race 40 and cam surfaces 44. In FIGS. 7 and 8, it can be seen that the spheres 50 are disposed in a track 54 formed in race 40 and a slot 56 formed in the cam surfaces 44. These two one-way devices (FIGS. 3 and 6) permit the same operation of the drive mechanism shown in FIG. 1, however, they do provide for a reduction of weight and also limited axial spacing.

Figure 9:
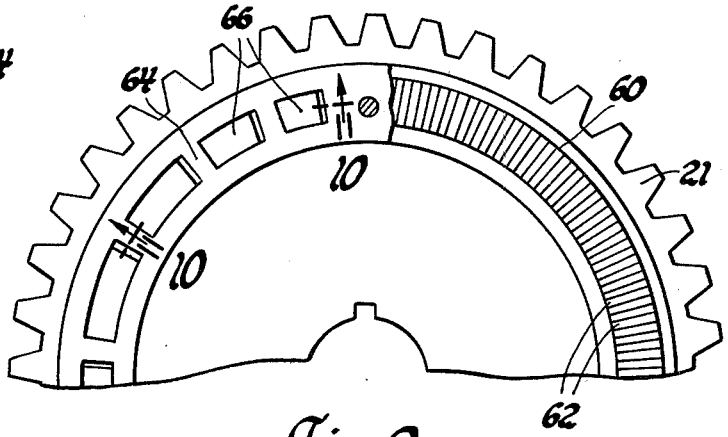
FIG. 9 is another embodiment of a portion of the drive mechanism shown in FIG. 1.
Figure 10:
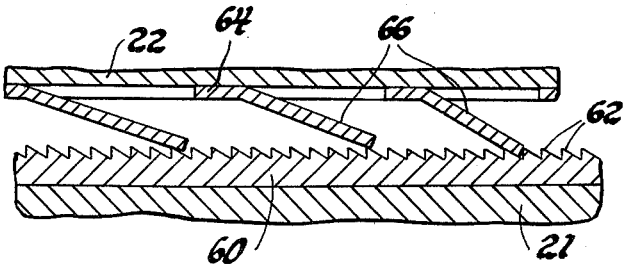
FIG. 10 is a view taken along line 10—10 of FIG. 9.

The one-way mechanism, shown in FIGS. 9 and 10, is a pawl and tooth mechanism wherein one race 60 has formed thereon a plurality of teeth 62 while the other race 64 has formed thereon a plurality of pawls or fingers 66. The race 60 is preferably secured to the sprocket 21 while the race 64 is secured to the sprocket 22. The teeth 62 are spaced at regular angular intervals while the pawls 66 are spaced at a varying angular interval. Each four pawls 66 will be formed in a pattern such that successive pawl members encompass an angle of $\frac{1}{4}°$ greater than the preceding pawl member. Thus, the teeth 62 will be engaged by every fourth pawl member. When a $\frac{1}{4}°$ of rotational difference occurs, the pawls 66 are ratcheted such that the next succeeding pawl 66 is placed in drive relation with a tooth 62. If a total of thirty-two pawls 66 are used, eight pawls 66 will be in drive relation with teeth 62 at any given time. With this staggered engagement, it can be seen that very minute steps can occur thus providing the desired one-way drive relationship.

It will be readily apparent to those skilled in the art, that various drive transmitting mechanisms can be utilized between camshaft 14 and sprocket 22 to maintain the desired tautness in chain 20 while permitting some relative motion between the sprocket 22 and the camshaft 14. This mechanism permits each of the chains 18 and 20 to have a slack side which improves the lubrication of the pin joint on a round pin chain.

Obviously, many modifications and variations of the present invention are possible in light of the above teaching. It is therefore to be understood, that within the scope of the appended claims, the invention may be practiced otherwise than as specifically described.

The embodiments of the invention in which an exclusive property or privilege is claimed are defined as follows:

1. An improvement in valve timing drives for internal combustion engines having a crankshaft, a camshaft and a flexible drive transmitting member drivingly connecting said crankshaft and said camshaft for enforcing conjoint rotation, said flexible drive transmitting member having a normally taut side and a normally slack side and said camshaft being subjected to cyclic torque reversals during normal operation of said engine, said improvement comprising; a one-way drive transmitting member drivingly connected to said camshaft; and flexible drive transmitting means drivingly connected between said crankshaft and said one-way drive transmitting member and having a normally taut side opposite said first mentioned taut side, said one-way drive transmitting member being operable to transmit drive through said flexible drive transmitting means to said crankshaft during the cyclic torque reversal whereby both of said taut sides remain taut during normal operation.

2. An improvement in valve timing drives for internal combustion engines having a crankshaft, a camshaft and a flexible drive transmitting member drivingly connecting said crankshaft and said camshaft for enforcing conjoint rotation, said flexible drive transmitting member having a normally taut side and a normally slack side and said camshaft being subjected to cyclic torque reversals during normal operation of said engine, said improvement comprising; a one-way drive transmitting member having a first member drivingly connected to said camshaft, a second member axially spaced from said first member and including a sprocket formed on the outer surface thereof, cam surface means formed on the axial face of one of the first or second members, and a drive means disposed between said first and second members adjacent and abutting said cam surface means; and flexible drive transmitting means including a toothed portion drivingly connected between said crankshaft and said sprocket and having a normally taut side opposite said first mentioned taut side, said one-way drive transmitting member being operable to transmit drive through said flexible drive transmitting means to said crankshaft during the cyclic torque reversal whereby both of said taut sides remain taut during normal operation.

3. A valve timing drive for internal combustion engines comprising: a crankshaft; sprocket means driven by said crankshaft; a camshaft; a sprocket driven by said camshaft; a first toothed flexible drive transmitting member drivingly connecting said crankshaft driven sprocket means and said camshaft driven sprocket for enforcing conjoint rotation, said toothed flexible drive transmitting member having a normally taut span and a normally slack span and said camshaft being subjected to cyclic torque reversals during normal operation of said engine; a one-way drive transmitting member drivingly connected to said camshaft; a sprocket drivingly connected to said one-way drive transmitting member for drive in one direction by said camshaft; and a second toothed flexible drive transmitting member drivingly connected between said crankshaft driven sprocket means and said sprocket drivingly connected to said one-way drive transmitting member and having a normally taut span opposite said first mentioned taut span, said one-way drive transmitting member being operable to transmit drive through said second toothed flexible drive transmitting member to said crankshaft during the cyclic torque reversal whereby both of said taut spans remain taut during normal operation.

* * * * *